United States Patent [19]

Ohst et al.

[11] Patent Number: 4,894,312

[45] Date of Patent: Jan. 16, 1990

[54] DYE DIFFUSION PROCESS WITH BASE PRECURSOR SALTS OF STRONG ORGANIC BASES AND WEAK ORGANIC ACIDS

[75] Inventors: Holger Ohst, Bergisch Gladbach; Carlhans Süling, Odenthal; Günther Schenk, Cologne; Kaspar Wingender; Manfred Peters, both of Leverkusen; Immo Boie, Leichlingen, all of Fed. Rep. of Germany

[73] Assignee: Agfa-Gevaert Aktiengesellschaft, Leverkusen, Fed. Rep. of Germany

[21] Appl. No.: 201,948

[22] Filed: Jun. 3, 1988

[30] Foreign Application Priority Data

Jun. 13, 1987 [DE] Fed. Rep. of Germany ..... 3719765

[51] Int. Cl.[4] ..... G03C 5/54

[52] U.S. Cl. ..... 430/203; 430/617; 430/955

[58] Field of Search ..... 430/203, 617, 955

[56] References Cited

U.S. PATENT DOCUMENTS

| | | | |
|---|---|---|---|
| 4,514,493 | 4/1985 | Hirai et al. | 430/203 |
| 4,639,418 | 1/1987 | Yabuki et al. | 430/203 |
| 4,668,615 | 5/1987 | Kawata et al. | 430/203 |
| 4,704,345 | 11/1987 | Hirai et al. | 430/203 |
| 4,761,361 | 8/1988 | Ozaki et al. | 430/203 |
| 4,770,970 | 9/1988 | Schranz et al. | 430/203 |

*Primary Examiner*—Richard L. Schilling

*Attorney, Agent, or Firm*—Connolly & Hutz

[57] ABSTRACT

Dye diffusion images can be produced by a rapid process in which a first sheet material which contains at least one light sensitive silver halide emulsion on a layer support and at least one color producing compound capable of releasing a diffusible dye on development and/or a second, light insensitive sheet material containing a layer of binder in which is incorporated a salt of a weakly acidic organic compound and a strong organic base is or are moistened with an aqueous liquid and the two sheet materials are then heated to 40°–120° C. with their coated surfaces in contact and subsequently separated.

6 Claims, No Drawings

DYE DIFFUSION PROCESS WITH BASE PRECURSOR SALTS OF STRONG ORGANIC BASES AND WEAK ORGANIC ACIDS

This invention relates to a process for the production of colour images by the dye diffusion process in which development is carried out in the presence of a base which is released from a base precursor compound under the conditions of development.

It is known that colour images can be produced by a heat treatment of suitable colour photographic recording materials. Particularly suitable colour producing compounds for this purpose are those which can be incorporated in a non-diffusible form in the layer of a photographic recording material and of releasing a diffusible dye as a result of development (dye releasing compounds).

The special suitability of such dye releasing compounds is based on the fact that the dyes which are released imagewise can be transferred to separate image receptor layers to form a brilliant colour image which has no image silver or silver halide superimposed on it and therefore requires no after treatment. An advantageous rapid process for the production of colour images is thus obtained by a combination of heat development and dye diffusion. A suitable recording material for this purpose is described, for example, in DE-A-32 15 485.

According to the above mentioned publication, a recording material having a layer which contains a combination of silver halide, silver benzotriazole, a dry releasing compound and guanidine trichloroacetate (base donor) is exposed imagewise and then subjected to a heat treatment in contact with an image receptor sheet, and the dye which is released imagewise is transferred to the image receptor sheet. For the production of multi colour images it is necessary to provide several such combinations in each of which the silver halide is sensitive to a different spectral region of light and contains, associated with it, a dye releasing compound which is suitable for the particular spectral sensitivity of the silver halide and releases a dye of a different colour, in most cases a colour which is complementary to the colour of the light to which the particular silver halide is predominantly sensitive. Such associations may be arranged one above the other in different layers.

Alkaline conditions are necessary for the development and in particular the diffusion of the released dyes. These conditions are obtained, for example, from the decomposition of the above mentioned base donor as a result of the heat treatment. If, on the other hand, alkaline conditions are established prematurely, e.g. if the base donor is insufficiently stable or if a base is present in the free form in the recording material, then the recording material will be insufficiently stable and it will be difficult to obtain sufficient density difference between the regions of strong and weak exposure, especially if the recording material is stored for some time before use.

Numerous chemical compounds have already been proposed as base donors, e.g. in DE-A-35 29 930, DE-A-35 29 934, DE-A-35 30 053, DE-A-35 30 063, DE-A-35 30 201, DE-A-35 30 213, and DE-A-35 30 214 but none of these has brought completely satisfactory results.

It is also known (e.g. from EP-A-0 121 765), that the transfer of an imagewise distribution of mobile dyes from an originally light sensitive layer into an image receptor layer may be carried out by a heat treatment in the presence of water, for example by bringing an image receptor sheet which has been moistened with water into contact with an already developed sheet which contains the mobile dyes. The base required for the dye diffusion is present in the originally light sensitive sheet in which it has been released from a base precursor compound by the heat treatment of the development process in the absence of water. This method has, of course, all the disadvantages of those processes in which the thermolabile base donors are in close contact with the light sensitive layers and the base is released from the donor by the heat treatment of the development process.

It is an object of the present invention to provide a photographic dye diffusion process by which sharp diffusion images with high maximum colour density and low fog can be produced by a simple heat treatment even if the recording material has been stored for some time before use.

The present invention relates to a process for the production of colour images by the photographic dye diffusion process in which a first sheet material which contains, on a layer support, at least one light sensitive silver halide emulsion layer and at least one colour producing compound which is capable of giving rise to an imagewise distribution of a diffusible dye as a result of development and/or a second, light insensitive sheet material containing a base precursor compound is or are moistened with an aqueous liquid and the two sheet materials are then together heated to 40° to 120° C. with their coated surfaces in contact and subsequently separated, characterized in that the second sheet material contains a salt of a weak acidic organic compound and a strong organic base as base precursor compound in at least one layer of binder. The weak acidic organic compound preferably has a $pK_A$ value above 6.

Premature contact of the light sensitive material with the base or the base precursor compound is avoided in the process according to the invention. This is achieved by incorporating the base in the form of a base precursor compound in a light insensitive material which is stored separately from the light sensitive material and is not brought into contact with the latter until development takes place. Furthermore, release of the base is not brought about by thermal decomposition of the base precursor compound but by its hydrolysis. This requires the presence of water since the base precursor compound used according to the invention is thermally stable at the processing temperatures. Since the base is already required at the stage of development, this means that the presence of water during development is an essential feature of the process according to the invention whereas in known photothermographic processes development proper is brought about by heating in the absence of water ("in a substantially water-free condition").

For carrying out the process according to the invention it is necessary to use a light insensitive sheet material which has at least one layer of binder with a salt of a weakly acidic organic acid and a strong organic base dispersed therein on a transparent or opaque layer support. This light insensitive sheet material serves as processing auxiliary sheet and optionally also as image receptor material. It is brought into surface contact with the coated side of the imagewise exposed light sensitive sheet material after at least one of these two sheet materials has been adequately moistened with an aqueous liquid. The resulting laminate is heated to 40°-120° C. and then separated after a sufficient contact time for development and dye diffusion, e.g. after 5 to 200 seconds.

Strong organic bases which are suitable for the process according to the invention and which may be used in the form of their salts with weakly acidic organic compounds include, for example, amidines, guanidines, their derivatives and vinylogous compounds derived therefrom. Many of these compounds may be represented by the following formula I

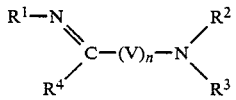

(I)

wherein $R^1$, $R^2$ and $R^3$ denote H or alkyl;

$R^4$ denotes H, alkyl, aryl or an amino group (e.g.

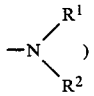

or a guanidine group or $R^1$ together with $R^2$ stands for an alkylene group with 2, 3 or 4 carbon atoms and/or $R^3$ together with $R^4$ stands for an alkylene group with 3, 4 or 5 carbon atoms, a vinylene group, a divinylene group (e.g. —CH=CH—CH=CH—) or a group of the formula

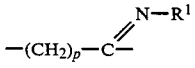

wherein $R^1$ has the meaning indicated above and p has the value 2, 3 or 4:

or $R^2$ together with $R^3$ denotes an alkylene group with 4, 5 or 6 carbon atoms optionally interrupted by a heteroatom (e.g. S or N);

V denotes a vinylene group, in particular —CH=CH—; and n stands for 0 or 1.

An aryl group denoted by $R^4$ may in particular be a phenyl group which may be substituted or unsubstituted, the substituents preferably having an electron donor character (e.g. methyl, methoxy or amino).

The alkyl groups optionally denoted by $R^1$, $R^2$, $R^3$ and $R^4$ may be identical or different and straight chained or branched and generally have up to 12 carbon atoms, preferably 1 to 3 carbon atoms.

Specific examples of suitable bases are shown below but the invention is not limited to these examples.

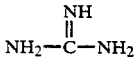

B-1

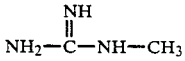

B-2

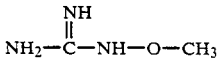

B-3

-continued

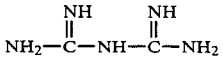

B-4

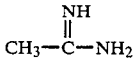

B-5

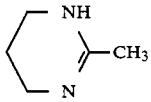

B-6

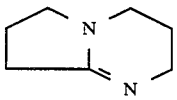

B-7

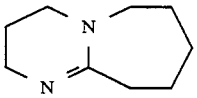

B-8

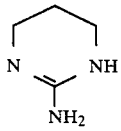

B-9

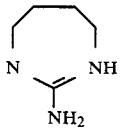

B-10

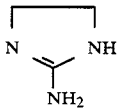

B-11

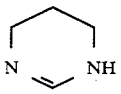

B-12

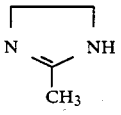

B-13

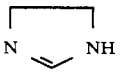

B-14

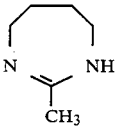

B-15

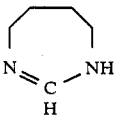

B-16

-continued

B-17

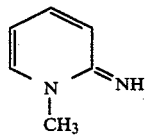

B-18

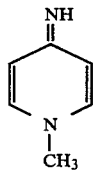

B-19

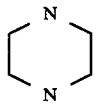

B-20

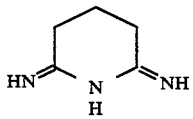

B-21

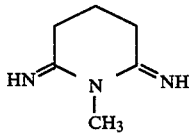

B-22

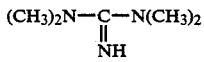

B-23

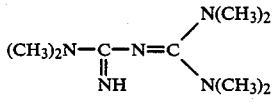

B-24

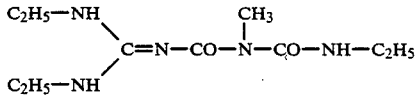

B-25

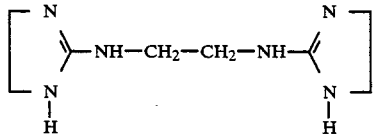

-continued

B-26

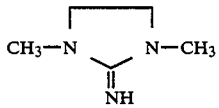

B-27

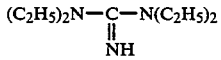

The bases are used as salts of a weakly acidic organic compound, in particular an organic compound having a $pK_A$ value of above 6.

The weakly acidic organic compounds (hereinafter referred to as acids) may contain, for example, one or more of the following groups:

—COOH

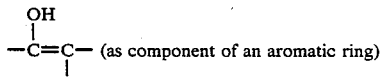

—$SO_2$—NH—

—$SO_2$—$CH_2$—X

—CO—NH—X

—CO—$CH_2$—X wherein X stands for —CO—, —$SO_2$— or

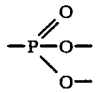

The weakly acidic compounds may be compounds containing a heterocyclic NH group, in particular compounds in which the NH group is a ring member of an aromatic ring. The weakly acidic compounds may be present in the form of low molecular weight compounds, preferably with a molecular weight of less than 400, or they may be in the form of polymers. They preferably correspond to the following formula II $$R^5—SO_2—NH—R^6 \qquad \text{II}$$

wherein $R^5$ stands for alkyl, aryl or a heterocyclic group, all of which may be either substituted or unsubstituted, and $R^6$ may have the same meaning as $R^5$ or it may stand for hydrogen.

Examples of acids according to the present invention are shown below:

A-1

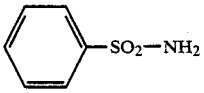

A-2

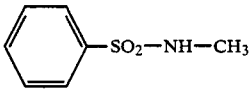

-continued
A-3
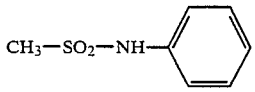
A-4
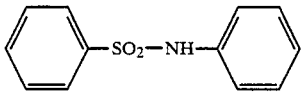
A-5
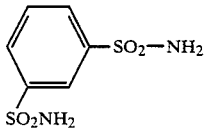
A-6
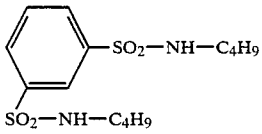
A-7
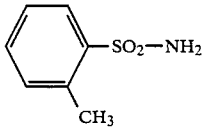
A-8
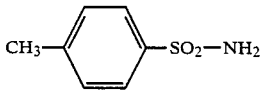
A-9
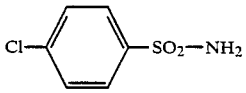
A-10
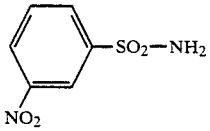
A-11
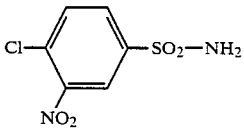
A-12
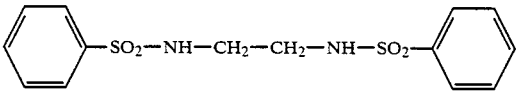
$H_2N-SO_2-CH_2-NH-(CH_2)_6-NH-CH_2-SO_2-NH_2$ A-13
A-14
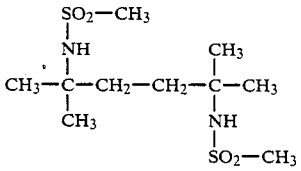

-continued
A-15
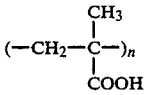
A-16
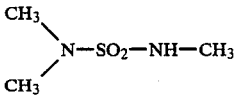
A-17
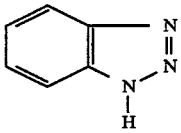
A-18
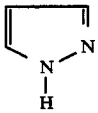
A-19
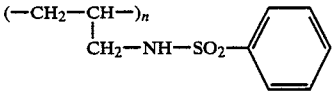
A-20
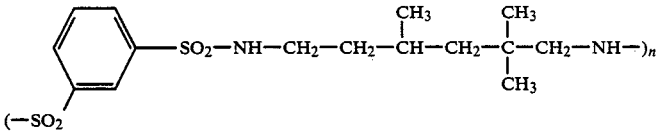
A-21
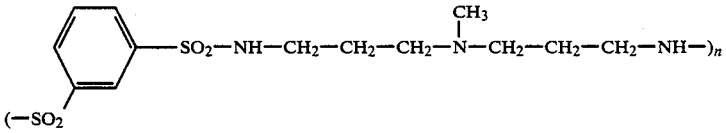
A-22
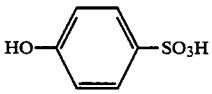
A-23
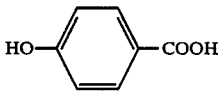
A-24
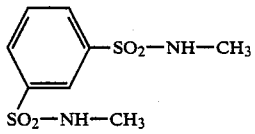
Compounds A-15, A-19, A-20 and A-21 are oligomers or polymers in which the structures shown above are present two or more times.
The following are suitable salts according to the present invention:
| Salt (S=) | Acid (A−) | Base (B−) |
|---|---|---|
| 1 | 1 | 1 |
| 2 | 2 | 1 |
| 3 | 3 | 1 |
| 4 | 4 | 1 |
-continued
| | | |
|---|---|---|
| 5 | 5 | 2 × 1 |
| 6 | 6 | 2 × 1 |
| 7 | 7 | 1 |
| 8 | 8 | 1 |
| 9 | 9 | 1 |
| 10 | 10 | 1 |
| 11 | 11 | 1 |
| 12 | 12 | 2 × 1 |
| 13 | 13 | 2 × 1 |
| 14 | 14 | 2 × 1 |
| 15 | 15 | 1 |
| 16 | 16 | 1 |

-continued

| | | |
|---|---|---|
| 17 | 1 | 7 |
| 18 | 7 | 7 |
| 19 | 8 | 7 |
| 20 | 9 | 7 |
| 21 | 10 | 7 |
| 22 | 11 | 7 |
| 23 | 1 | 8 |
| 24 | 7 | 8 |
| 25 | 8 | 8 |
| 26 | 1 | 19 |
| 27 | 7 | 19 |
| 28 | 8 | 19 |
| 29 | 9 | 19 |
| 30 | 10Π | 19 |
| 31 | 11 | 19 |
| 32 | 1 | 23 |
| 33 | 9 | 23 |
| 34 | 10 | 23 |
| 35 | 1 | 24 |
| 36 | 1 | 6 |
| Salt (S) | Acid (A) | Base (B) |
| 37 | 1 | 25 |
| 38 | 10 | 25 |
| 39 | 1 | 26 |
| 40 | 9 | 26 |
| 41 | 10 | 26 |
| 42 | 1 | 27 |
| 43 | 9 | 27 |
| 44 | 10 | 27 |
| 45 | 1 | 22 |
| 46 | 7 | 22 |
| 47 | 8 | 22 |
| 48 | 9 | 22 |
| 49 | 10 | 22 |
| 50 | 11 | 22 |
| 51 | 17 | 22 |
| 52 | 18 | 22 |
| 53 | 20 | 2 × 1 |
| 54 | 22 | 22 |
| 55 | 23 | 22 |
| 56 | 24 | 2 × 1 |
| 57 | 24 | 22 |
| 58 | 24 | 26 |

The light insensitive sheet material in which one of the salts according to the invention is incorporated serves primarily to provide the alkali required for the process according to the invention in the form of a base which is released from the based precursor compound by hydrolysis when development is carried out in the presence of water. It may also fulfil other functions. For example, it may contain a layer of dye mordant capable of absorbing diffusible dyes if the dye mordant layer is not present as an integral component of the light sensitive sheet material.

The dye mordant layer serves as image receptor layer for taking up and fixing the dyes which have become diffusible in imagewise distribution as a result of development. It consists substantially of a binder containing mordant for fixing the diffusible dyes which have been formed from the colour producing compounds. The mordants used for anionic dyes are preferably long chained quaternary ammonium or phosphonium compounds, e.g. those described in U.S. Pat. Nos. 3 271 147 and 3 271 148.

Certain metal salts and their hydroxides which form sparingly soluble compounds with the acid dyes may also be used. Polymeric mordants should also be mentioned, for example those described in DE-A-23 15 304, DE-A-26 31 521 or DE-A-29 41 818. Other preferred mordants are the polyvinyl imidazol mordants which are partially quaternized, for example with benzyl, hydroxyethyl, alkyl, epoxipropyl, propyl, methyl or ethyl halides with a degree of quaternization of from 1 to 50%. The dye mordants are dispersed in the mordant layer in one of the conventional hydrophilic binders, e.g. in gelatine, polyvinyl alcohol, polyvinyl pyrrolidone, or partially or completely hydrolysed cellulose esters. Some binders may, of course, themselves function as mordants, e.g. polymers of nitrogen-containing, optionally quaternary bases such as N-methyl-4-vinyl pyridine, 4-vinyl pyridine or 1-vinyl-imidazole, for example as described in U.S. Pat. No. 2,484,430. Further examples of suitable mordanting binders are the guanylhydrazone derivatives of alkyl vinyl ketone polymers as described, for example, in U.S. Pat. No. 2,882,156, and guanylhydrazone derivatives of acyl styrene polymers as described, for example, in DE-A-20 09 498, but the last mentioned mordanting binders would generally be used in combination with other binders, e.g. gelatine.

The colour photographic recording material used for the processing according to the invention has at least one layer of binder mounted on a dimensionally stable layer support and containing a light sensitive silver halide, optionally in combination with a substantially light insensitive silver salt, and a colour producing compound capable of yielding a diffusible dye as a result of development.

Silver halide is thus an essential component of the colour photographic recording material used according to the invention. The silver halide may consist of silver chloride, silver bromide, silver iodide or mixtures thereof and may have a particle size of from 0.02 to 2.0 μm, preferably from 0.1 to 1.0 μm. The silver halide grains may have a regular crystal structure, for example in the form of cubes or octahederons, or they may have an irregular crystal structure or be in the form of platelets. In mixed crystals, the silver halides may be uniformly distributed over the whole cross section of the crystal or the silver halide composition may vary in different regions. Silver halide emulsions with a layered grain structure may be used, in which at least two layers have a different silver halide composition. Silver halide emulsions which function as negative emulsions are generally used but direct positive silver halide emulsions may be used in other embodiments, for example as described in DE-A-23 32 802, DE-A-23 08 239 and DE-A-22 11 728. The light sensitive emulsion may consist of unsensitized silver halide or it may be chemically and or spectrally sensitized by suitable additives, the spectral sensitizer being added before, during or after chemical ripening.

The quantity of light sensitive silver halide in a layer may be from 0.01 to 3.0 g per $m^2$, the quantity in any particular layer depending on the requirements of the reactants and the desired effects.

Photographic recording materials which are developable by heat treatment may, as is known, in many cases contain substantially light insensitive or at least very much less light sensitive silver salts in addition to the light sensitive silver halides. These added salts are advantageously organic silver salts which have approximately the same or less solubility than the light sensitive silver halide. Silver salts of organic cyclic imino compounds, for example, are suitable. In preferred examples, these include silver salts of benzotriazole and its derivatives, for example alkyl, hydroxy-, sulpho- or halogen-substituted benzotriazoles. The organic silver salt compound may be added in a molar quantity equal to, greater than or less than the molar quantity of the silver halide compound and should be adapted to the particular requirements in the combination of layers.

Another essential component of the light sensitive recording material used in the process according to the invention is a colour producing compound. This is capable of releasing a diffusible dye as a result of a redox reaction which takes place in the development process. Preferred colour producing compounds are referred to below as dye releasing compounds.

The dye releasing compounds used according to the invention may be any of numerous types of compounds which are all distinguished by having a connecting member which is redox dependent in the strength of its bond and links a dye residue to a carrier group which contains a ballast residue.

See in this connection a summarising report of the field in Angew. Chem. Int. Ed. Engl. 22 (1983), 191–209, in which the most important of the known systems are described.

Redox active dye releasing compounds of the formula

BALLAST-REDOX-DYE.

are particularly suitable.

In this formula,

BALLAST denotes a ballast residue,

REDOX denotes a redox active group, i.e. a group which is oxidizable or reducible under the conditions of alkaline development and which, depending on whether it is present in the oxidized or reduced state, is capable of undergoing to various extents an elimination reaction, a nucleophilic displacement reaction, hydrolysis or some other decomposition reaction as a result of which the DYE residue is split off, and DYE denotes the residue of a diffusible dye, e.g. a yellow, magenta or cyan dye, or the residue of a dye precursor.

Ballast residues are residues which enable the dye releasing compounds according to the invention to be incorporated in a diffusion fast form in the hydrophilic colloids conventionally used in photographic materials. Particularly suitable for this purpose are organic residues generally containing straight chained or branched aliphatic groups with generally 8 to 20 carbon atoms and optionally also carbocyclic or heterocyclic, optionally aromatic groups. The residues are connected to the remainder of the molecule either directly or indirectly, e.g. through one of the following groups: —NHCO—, —$NHSO_2$—, —NR—, (wherein R stands for hydrogen or alkyl), —O— or —S—. The ballast residue may in addition also contain water solubilizing groups, e.g. sulpho groups or carboxyl groups, which may also be present in an anionic form. Since the diffusion properties depend on the molecular size of the whole compound, it is in some cases sufficient, for example if the molecule as a whole is large enough, to use shorter chained residues as ballast residues.

Redox active carrier residues having the structure BALLAST-REDOX-and appropriate dye releasing compounds are known in a wide variety of embodiments. A detailed description is not necessary here in view of the above mentioned survey in Angew. Chem. Int. Ed. Engl. 22 (1983) 191–209.

Some examples of redox active carrier residues from which a dye residue is split off in accordance with a previous imagewise oxidation or reduction are shown below purely for illustration:

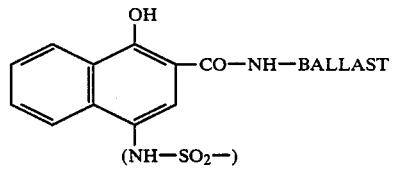

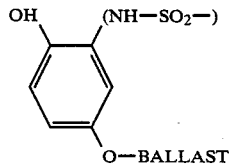

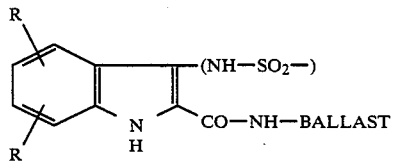

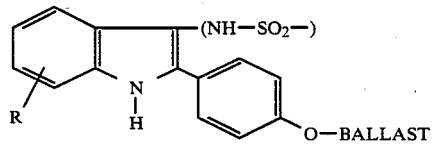

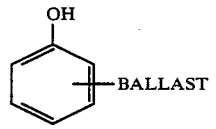

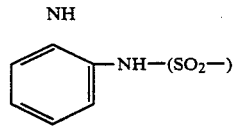

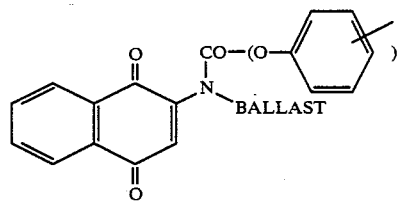

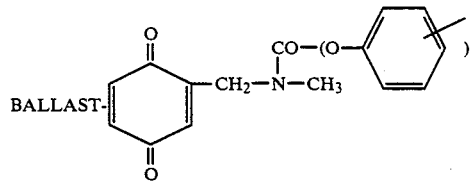

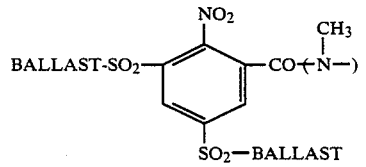

-continued

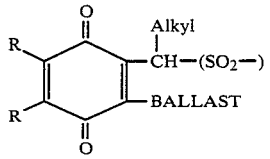

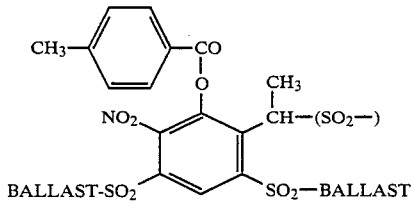

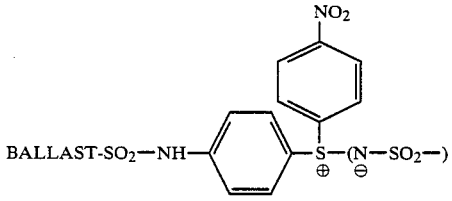

The groups enclosed in brackets are functional groups of the dye residue and are separated together with this residue from the remaining part of the carrier residue. The functional group may be a substituent which may have a direct influence on the absorption and optionally complex forming properties of the released dye. The functional group may also be separated from the chromophore of the dye by an intermediate or linking member. Lastly, the functional group may be of significance in combination with the connecting member in determining the diffusion and mordanting characteristics of the released dye. Alkylene and aryl groups, for example, are suitable connecting members.

The dye residues may in principle be residues from any classes of dyes, provided they are sufficiently diffusible to diffuse from the light sensitive layer of the light sensitive material into an image receptor layer. The dye residue may have one or more alkali solubilising groups for this purpose. Suitable alkali solubilising groups include inter alia carboxyl groups, sulpho groups, sulphonamide groups and aromatic hydroxyl groups. Such alkali solubilising groups may already be preformed in the dye releasing compounds used according to the invention or they may result from a splitting off of the dye residue from the carrier residue which carries ballast groups. The following are dyes which are particularly suitable for the process according to the invention: azo dyes, azomethine dyes, anthraquinone dyes, phthalocyanine dyes, indigoid dyes, triphenylmethane dyes, including dyes which are in the form of complexes or capable of forming complexes with metal ions.

Residues of dye precursors are residues of compounds which are capable of being converted into dyes in the course of the photographic process, in particular under the conditions of heat development, either by oxidation or by coupling or by complex formation or by exposure of an auxochromic group in a chromophor system, for example by saponification. Dye precursors in this sense may be leuco dyes, couplers or dyes which are converted into other dyes in the course of processing. Where it is not important to make a distinction between dye residues and residues of dye precursors, the term "dye residues" used hereinafter will also include the latter.

Suitable dye releasing compounds have been developed, for example, in the following documents: U.S. Pat. Nos. 3,227,550, 3,443,939, 3,443,940, DE-A-1 930 215, DE-A-2 242 762, DE-A-2 402 900, DE-A-2 406 664, DE-A-2 505 248, DE-A-2 543 902, DE-A-2 613 005, DE-A-2 645 656, DE-A-2 809 716, DE-A-2 823 159, DE-A-861 241, EP-A-0 004 399, EP-A-0 004 400, DE-A-3 008 588, DE-A-3 014 669, EP-A-0 038 092.

In some embodiments of the heat development process according to the invention, the dye releasing compounds may be present in an oxidizable form or capable of undergoing coupling reactions while in others they may be present as reducible dye releasing compounds. When conventional negative silver halide emulsions are used, the copy obtained from the original is a negative or positive copy depending on whether the dye has been released from the oxidized or the reduced form of the dye releasing compound. Either positive or negative images may therefore be produced as desired by suitable choice of the dye releasing systems.

Particularly suitable oxidizable dye releasing compounds are described, for example, in DE-A-2 645 656.

If the dye releasing compound is oxidizable, it constitutes a reducing agent which is oxidized by the imagewise exposed silver halide either directly or indirectly by the action of electron transfer agents (ETA). An imagewise differentiation in the capacity to release the diffusible dye is then obtained. If, on the other hand, the dye releasing compound is reducible, then it is advantageously used in combination with a limited quantity of reducing agent present, a so called electron donor compound or electro donor precursor compound, which in this case is present side by side with the dye releasing compounds and light sensitive silver halide in the same layer of binder. The addition of electron transfer agents may also be advantageous when reducible dye releasing compounds are used in combination with electron donor compounds.

For the production of positive colour images from positive originals when negative silver halide emulsions are used it is suitable, for example, to use a recording material according to the invention which contains reducible dye releasing compounds with a carrier residue corresponding to the following formula:

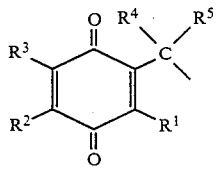

"Carquin"

wherein $R^1$ denotes alkyl or aryl;

$R^2$ denotes alkyl, aryl or a group which together with $R^3$ completes a condensed ring;

$R^3$ denotes hydrogen, alkyl, aryl, hydroxyl, halogen such as chlorine or bromine, amino, alkylamino, dialkylamino including cyclic amino groups (such as piperidino or morpholino), acylamino, alkylthio, alkoxy, aroxy, sulpho or a group which together with $R^2$ completes a condensed ring;

$R^4$ denotes alkyl;

$R^5$ denotes alkyl or preferably hydrogen,
and at least one of the groups $R^1$ to $R^4$ contains a ballast residue.

The electron donor compound which is used in combination with a reducible dye releasing compound serves as reducing agent both for the silver halide and the dye releasing compound. Since the silver halide and the dye releasing compound compete with each other for the oxidation of the electron donor compound and the silver halide is superior to the dye releasing compound in this reaction, the silver halide present determines, in accordance with a previous imagewise exposure, the areas of image within which the dye releasing compound will be converted into its reduced form by the electron donor compound.

Under the conditions of development, e.g. when the imagewise exposed colour photographic recording material is heated, the electron donor compound which is present in a limited quantity is oxidized according to the amount of exposure which has taken place and is therefore no longer available for a reaction with the dye releasing compound. An imagewise distribution of unused electron donor compound is therefore obtained.

Compounds which have been described as electron donor compounds include, for example, non-diffusible or only slightly diffusible derivatives of hydroquinone, of benzisoxazolone, of p-amino phenol or of ascorbic acid (e.g. ascorbyl palmitate) (DE-A-2 809 716).

Further examples of electron donor compounds are known from DE-A-2 947 425, DE-A-3 006 268, DE-A-3 130 842, DE-A-3 144 037, DE-A-3 217 877 and EP-A-0 124 915 and Research Disclosure 24 305 (July 1984). It has been found that the above mentioned electron donor compounds will satisfy the given requirements under the conditions of heat development and are therefore suitable as electron donor compounds for the purpose of the present invention. Particularly suitable are those electron donor compounds which are formed from the electron donor precursor compounds under the conditions of thermal development in the layer, i.e. electron donor compounds which are only present in a masked, virtually inactive form in the recording material before development takes place. Under the conditions of heat development, the initially inactive electron donor compounds are converted into their active form, for example by the removal of certain protective groups by hydrolysis. In the present case, the above mentioned electron donor precursor compounds are also referred to as electron donor compounds.

In another embodiment, dye releasing compounds which are capable of coupling and of releasing a diffusible dye as a result of a coupling reaction may also be used. This includes two possibilities. In the first case, the dye does not exist until it is formed by a process of chromogenic coupling in which a diffusion inhibiting ballast group is split off from the coupling position. In the second case, non diffusible couplers carry, in the coupling position, a preformed dye residue as fugitive group which is split off by the coupling reaction and becomes diffusible. Such systems have been described, for example, in U.S. Pat. No. 3,227,550. The dye releasing compounds may also be polymeric couplers of the type which release dyes, for example as described in DE-A-34 22 455.

In another embodiment, the colour producing compound may be a so called developer dye, i.e. a compound which contains both a dye residue and a residue which can be oxidized by exposed silver halide or by developer oxidation products and thereby rendered immobilisable. The oxidisable residue is generally a hydroquinone residue. Developer dyes of this type which give rise to a positive transfer image when used in combination with conventional silver halide emulsion have been known for a long time and described, for example, in DE-B-1 196 075, U.S. Pat. Nos. 2,983,606, 3,415,644 and 3,594,164. These have also been described in combination with a process in which development is carried out by heat treatment, e.g. EP-A-0 192 272.

The above mentioned essential components of the colour photographic recording material, namely the silver halide emulsion and the colour producing compound, e.g. a dye releasing compound optionally in combination with an electron donor compound, are dispersed in one and the same binder. This may be a hydrophobic binder or a hydrophilic binder although the latter are preferred. The binder preferably used for the light sensitive layer is gelatine although this may be partly or completely replaced by other natural or synthetic binders. Examples of suitable natural binders include alginic acid and its derivatives such as its salts, esters or amides, cellulose derivatives such as carboxymethyl cellulose, alkyl celluloses such as hydroxy ethyl cellulose, starch and its derivatives and caragenates. The following are synthetic binders: polyvinyl alcohol, partially supponified polyvinyl acetate and polyvinyl pyrrolidone.

Examples of hydrophobic binders include polymers of polymerisable, ethylenically unsaturated monomers such as alkyl acrylates, alkyl methacrylates, styrene, vinyl chloride, vinyl acetate, acrylonitrile and acrylamides. Polyesters, polyurethane compounds and waxes may also be used. Polymers of this type may be used, for example, in latex form.

For the production of monochrome colour images, the light sensitive layer of binder contains one or more dye releasing compounds associated with the light sensitive silver halide. Each of these compounds releases a dye of a particular colour and the colour finally obtained may be the result of mixing several dyes. It is thereby also possible to produce black and white images from an accurately adjusted mixture of several dye releasing compounds which give rise to different colours. For the production of multi colour images, the colour photographic material of the present invention contains several, i.e. generally three associations of dye releasing compounds with their silver halides sensitized to different regions of the spectrum, the absorption range of the dye released from the dye releasing compound preferably corresponding substantially to the region of spectral sensitivity of the associated silver halide. The various associations of dye releasing compounds with silver halide may be accommodated in different layers of binder of the colour photographic recording material, in which case separating layers of a water permeable binder such as gelatine containing, for example, a scavenger for developer oxidation products are preferably arranged between the different layers of binder, mainly to separate the various associations from one another and thereby counteract any falsification of colour. In such a case, the colour photographic recording material of the present invention may contain, for example, a light sensitive layer of binder which contains a cyan dye releasing compound and in which the silver halide is predominantly sensitive to red as a result of spectral sensitization, another light sensitive layer of binder which contains a magenta dye releasing compound and in which the silver halide is predominantly sensitive to green as a result of spectral sensitization, and a third light sensitive layer binder which contains a yellow dye releasing compound and in which the silver halide is predominantly blue sensitive, either as a result of spectral sensitization or due to its intrinsic sensitivity. The allocations of sensitization to the different layers may also be altered, which may be advantageous, for example, if the imagewise exposure has taken place not with natural visible light but with CRT light, laser light, LED light or infrared light.

In another embodiment of the present invention, each of the above mentioned associations of light sensitive silver halide with dye releasing compound is used in the form of a so called complex coacervate.

A complex coacervate is a form of dispersion in which a mixture of the essential components are enclosed in a common sheath of hardened binder. Dispersions of this type are also known as packet emulsions and are obtained by complex coacervation.

Methods for the preparation of packet emulsions in which a colour producing substance is incorporated by complex coacervation are described, for example, in U.S. Pat. Nos. 3,276,869 and 3,396,026. The use of packet emulsions in heat developable recording materials is described, for example, in DE-A-35 10 685.

The use of packet emulsions according to the invention enables several emulsions including the corresponding dye releasing compounds to be accommodated in a single layer of binder without any loss of the spectral association and therefore without the risk of colour falsification. This is possible because the amount of dye released from a dye releasing compound present in the same coacervate particle (packet) as a particular silver halide particle is determined almost entirely by the amount of exposure of this silver halide particle. The use of packet emulsions therefore enables a blue sensitive, a green sensitive and a red sensitive silver halide emulsion and the spectrally associated dye releasing compound to be accommodated in the same layer of binder without any risk of serious colour falsification.

In addition to the compounds already mentioned, the colour photographic recording material according to the invention may contain other components and auxiliary substances, and these may be accommodated either in a light sensitive layer or in a light insensitive layer.

The auxiliary substances may be, for example, auxiliary developers which generally have developing properties for exposed silver halide. In the present case they mainly promote the reactions between the exposed silver halide and the reducing agent. If the dye releasing compound is oxidizable, this reducing agent may be identical with the dye releasing compound whereas a reducible dye releasing compound enters into a reaction with the reducing agent. Since this reaction consists mainly in a transfer of electrons, the auxiliary developers are also known as electron transfer agents (ETA).

The following are examples of suitable auxiliary developers: hydroquinone, pyrocatacol, pyrogallol, hydroxylamine, ascorbic acid, and 1-phenyl-3-pyrazolidone, and derivatives thereof, e.g. 4-methyl-1-phenyl-3-pyrazolidone, 4,4-dimethyl-1-phenyl-3-pyrazolidone, 4-hydroxymethyl-4-methyl-1-phenyl-3-pyrazolidone, 4-hydroxymethyl-4-methyl-1-tolyl-3-pyrazolidone and 4,4-dihydroxymethyl-1-phenyl-3-pyrazolidone. In certain cases it is advantageous to use these compounds in a masked form with a protective group which can be split off under alkaline conditions. Since these auxiliary developers have a catalytic function, they need not be present in stochiometric quantities. It is generally sufficient if they are present in the layer in quantities of up to ½ mol per mol of dye releasing compound. Their incorporation in the layer may be carried out, for example, from solutions in water soluble solvents or in the form of aqueous dispersions obtained with the aid of oil formers. When colour systems which undergo coupling reactions are used it is necessary to use colour developers, for example the conventional p-phenylene diamine developers or amino phenols. For reasons of stability it is advantageous to use the developer additives in a masked form with a protective group which is split off under the conditions of processing.

In some embodiments of the process according to the invention, the light sensitive element may contain an image receptor layer, especially if the light insensitive sheet material containing the base precursor compound does not already contain such an image receptor layer. The mordants used in such image receptor layers have already been mentioned. The image receptor layer may in such a case be arranged above the light sensitive layers or it may be arranged below them, between the light sensitive layers and the layer support. In either case, the layer support is transparent and an alkali permeable, light reflecting layer of binder containing pigment is situated between the image receptor layer and the light sensitive layers to serve as optical separation between the negative and the positive and as esthetically pleasing image background for the transferred positive colour image.

In integral layer units of light sensitive element and image receptor element, stripping layers may be used to separate the two layer elements.

The layer supports for the light sensitive element and optionally for the image receptor element must be dimensionally stable at the processing temperature. Conventional film supports or paper supports may be used, polyester materials being preferred.

The hardeners used both for the light sensitive element and for the image receptor element may be any hardeners conventionally used for photographic materials as well as rapid and instant hardeners. Suitable hardeners are described, for example, in DE-A-24 39 551.

The light sensitive element (=first sheet material) is exposed imagewise, optionally through the layer support if this is transparent. For processing, either the light sensitive element or the light insensitive sheet (=second sheet material) or both is or are moistened with a sufficient quantity of water or of a liquid consisting predominantly of water and the two materials are then placed together with their coated surfaces in contact and heated. The aqueous liquid may contain a wetting agent and/or water softener. After development and transfer of the colour image into the image receptor layer, the two sheet materials are separated. The transferred colour image is then visible either as an image to be viewed by reflected light or as a diapositive, depending on the photographic material.

EXAMPLE 1

A light sensitive element A of a colour photographic recording material for the dye diffusion process was prepared by the application of the layers described below to a transparent layer support of polyethylene terephthalate. The quantities indicated are based on 1 $m^2$.

Layer 1

A layer containing a green sensitized, sulphur-ripened silver halide emulsion of 0.5 g of $AgNO_3$ (20 mol % AgCl, 80 mol % AgBr, average grain diameter 0.41 um) with 0.05 g of 5-methyl-benzotriazole, 0.01 g of compound ST, 0.32 g of dye releasing compound M-1 (emulsified in 0.16 g of diethyl lauramide), 0.06 g of compound SC and 1.0 g of gelatine.

Layer 2

An interlayer of 1.4 g of gelatine with 0.3 g of compound SC, 0.035 g of 4,4-dimethyl-1-phenyl-3-pyrazolidone, 0.008 g of sodium sulphite, 0.1 g of 1-phenyl-5-cyanoethylthiotetrazole and 0.03 g of compound WA.

Layer 3

A protective layer containing 0.5 g of gelatine. The hardener is applied together with this layer.

Dye releasing compound M-1

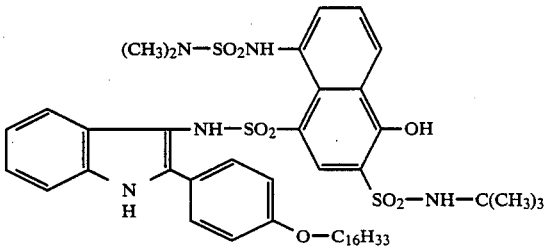

Compound ST

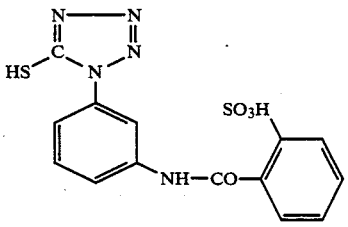

Compound SC

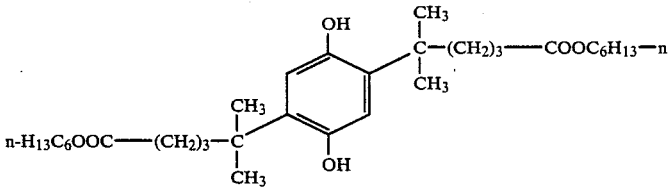

Compound WA

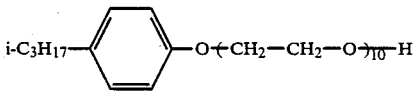

An image receptor element B for the recording material was prepared by applying the following layers in succession to a layer support of polyethylene-coated paper. The quantities indicated are based on 1 $m^2$.

Layer 1

A layer containing 4 g of guanidinium carbonate, 0.007 g of compound WA and 3 g of gelatine.

Layer 2

A mordant layer containing 2 g of polyurethane mordant (from 4,4-'-diphenyl methane diisocyanate and N-ethyl-diethanolamine, quaternized with epichlorohydrin according to DE-A-26 31 521, example 1), 0.035 g of compound WA and 2 g of gelatine.

Layer 3

An interlayer containing 1 g of gelatine.

Layer 4

A hardening layer containing 0.09 g of triacryloformal and 0.85 g of gelatine.

The recording material which had been exposed through a step wedge was processed by being immersed in water for three seconds and then heated to 90° C. for 30 seconds with its coated surface in contact with the image receptor element. The two elements were then separated and a magenta coloured negative copy of the exposure original was obtained on the image receptor element. When the densities were measured behind a green filter, the minimum density was found to be 0.12 and the maximum density 1.78.

EXAMPLES 2-16

The image receptor element B of Example 1 was modified for Examples 2-16 in that the guanidinium carbonate was replaced by an equivalent quantity of the salt (S-) used according to the invention. The transfer colour densities obtained (Dmin and Dmax) are shown in the following table:

TABLE

| Example | Salt (S—) | Application g/$m^2$ | Density Dmin | Density Dmax |
|---|---|---|---|---|
| 1 | guanidine carbonate | 4.0 | 0.12 | 1.78 |
| 2 | 1 | 3.0 | 0.15 | 1.60 |

TABLE-continued

| Example | Salt (S—) | Application g/m² | Density Dmin | Dmax |
|---|---|---|---|---|
| 3 | 7 | 5.1 | 0.09 | 1.88 |
| 4 | 8 | 5.6 | 0.11 | 1.39 |
| 5 | 16 | 4.4 | 0.12 | 1.87 |
| 6 | 32 | 7.6 | 0.14 | 2.16 |
| 7 | 39 | 6.0 | 0.20 | 2.33 |
| 8 | 40 | 6.8 | 0.86 | 2.32 |
| 9 | 42 | 7.3 | 0.12 | 1.69 |
| 10 | 47 | 6.36 | 0.15 | 2.26 |
| 11 | 48 | 6.8 | 0.24 | 2.23 |
| 12 | 53 | 5.3 | 0.10 | 1.65 |
| 13 | 54 | 4.5 | 0.09 | 1.44 |
| 14 | 56 | 4.25 | 0.15 | 2.03 |
| 15 | 57 | 8.4 | 0.10 | 1.57 |
| 16 | 58 | 8.4 | 0.10 | 1.64 |

EXAMPLE 17

The salts of weakly acidic organic compounds are particularly advantageous for providing stability in storage. Their tendency to diffuse to the surface and crystallize there is very slight in relation to the moisture content of the layers or the moisture content of the surroundings. The following salts were incorporated in layer 1 of the image receptor element B as described in Example 1 and stored under very moist conditions. The results (visual assessment) are shown in the following Table.

TABLE

| Salt | Fresh | 2 days 81% r.h./22° C. | 7 days 90% r.h./35° C. |
|---|---|---|---|
| guanidine carbonate | glossy | matt | matt |
| potassium carbonate | glossy | matt | matt |
| S-14 | glossy | glossy | glossy |
| S-33 | glossy | glossy | glossy |
| S-40 | glossy | glossy | glossy |
| S-48 | glossy | glossy | glossy |
| S-53 | glossy | glossy | glossy |
| S-54 | glossy | glossy | glossy |
| S-55 | glossy | glossy | glossy |
| S-56 | glossy | glossy | matt |

We claim:

1. Process for the production of color images by the photographic dye diffusion process in which a first light-sensitive sheet material is imagewise exposed, at least one of said first light-sensitive sheet material and a second light-insensitive sheet material is moistened with an aqueous liquid and the two sheet materials are heated to 50°–120° C. with their coated surfaces in contact and then separated, said first light-sensitive sheet material containing, on a layer support, at least one light-sensitive silver halide emulsion layer and at least one color providing compound which is capable of producing an imagewise distribution of a diffusible dye on development and said second light-insensitive sheet material containing in at least one binder layer a base precursor compound wherein said base precursor compound is a salt of a weakly acidic organic compound and a strong organic base and said weakly acidic compound corresponds to the following formula II:

$$R^5—SO_2—NH—R^6 \qquad \text{II}$$

wherein $R^5$ stands for alkyl, aryl or a heterocyclic group and $R^6$ stands for $R^5$ or hydrogen.

2. Process according to claim 1, characterized in that the strong organic base is guanidine or an amidine.

3. Process according to claim 2, characterized in that the strong organic base is a compound corresponding to the following Formula I

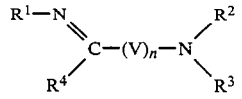

(I)

wherein $R^1$, $R^2$, $R^3$ denote H or alkyl and $R^4$ denotes H, alkyl, aryl, or an amino group or a guanidine group or $R^1$ together with $R^2$ denotes an alkylene group with 2, 3 or 4 carbon atoms and/or $R^3$ together with $R^4$ denotes an alkylene group with 3, 4 or 5 carbon atoms, or a vinylene group, a divinylene group or a group of the formula

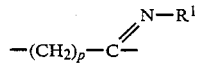

wherein $R^1$ has the meaning indicated and p stands for 2, 3 or 4;

or $R^2$ together with $R^3$ denotes an alkylene group with 4, 5 or 6 carbon atoms optionally interrupted by a heteroatom;

V stands for a vinylene group and n stands for 0 or 1.

4. Process according to claim 1, characterized in that the color providing compound used in the first sheet material is a redox active dye releasing compound corresponding to the following formula:

BALLAST-REDOX-DYE wherein

BALLAST denotes a ballast residue

REDOX denotes a redox active group, i.e., a group which is oxidizable or reducible under the conditions of alkaline development and which, depending on whether it is present in the oxidized or the reduced state, is capable of undergoing to varying extents a decomposition reaction with the result that the DYE residue is split off, and DYE denotes the residue of a diffusible dye or the residue of a dye precursor.

5. Process according to claim 4, characterized in that a reducible dye releasing compound containing a carrier residue of the following formula is used:

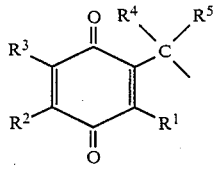

"Carquin"

wherein $R^1$ denotes alkyl or aryl, $R^2$ denotes alkyl, aryl or a group which together with $R^3$ completes a condensed ring, $R^3$ denotes hydrogen, alkyl, aryl, hydroxyl, halogen, amino, alkylamino or dialkylamino groups, acylamino, alkylthio, alkoxy, aroxy, sulpho or a group which together with $R^2$ completes a condensed ring, $R^4$ denotes alkyl, $R^5$ denotes alkyl or hydrogen, and at least one of the groups $R^1$ to $R^4$ contains a ballast residue.

6. Process according to claim 1, characterized in that the second, light insensitive sheet material contains a layer capable of absorbing diffusible dyes.

* * * * *